US006206635B1

(12) United States Patent
Golm et al.

(10) Patent No.: US 6,206,635 B1
(45) Date of Patent: Mar. 27, 2001

(54) FAN STATOR

(75) Inventors: Norman Golm, Rochester Hills, MI (US); Stéphane Moreau, Paris (FR)

(73) Assignee: Valeo, Inc., Auburn Hills, MI (US)

( * ) Notice: Subject to any disclaimer, the term of this patent is extended or adjusted under 35 U.S.C. 154(b) by 0 days.

(21) Appl. No.: 09/206,623

(22) Filed: Dec. 7, 1998

(51) Int. Cl.[7] ..... F04D 29/44

(52) U.S. Cl. ..... 415/209.1; 415/210.1; 415/193; 415/211.2

(58) Field of Search ..... 415/209.1, 208.2, 415/210.1, 191, 193, 209.2, 211.2

(56) References Cited

U.S. PATENT DOCUMENTS

| | | | | |
|---|---|---|---|---|
| 2,313,413 | * | 3/1943 | Weske | 415/211.2 |
| 3,173,604 | * | 3/1965 | Sheets et al. | 415/209.1 |
| 4,946,348 | * | 8/1990 | Yapp | 415/211.2 |
| 5,342,167 | * | 8/1994 | Rosseau | 415/208.2 |

* cited by examiner

*Primary Examiner*—F. Daniel Lopez
*Assistant Examiner*—Richard Woo
(74) *Attorney, Agent, or Firm*—Morgan & Finnegan LLP

(57) ABSTRACT

A stator device for an axial flow fan has a plurality of first stator elements and a corresponding plurality of second stator elements, the first stator elements being disposed axially rearwardly of the second stator elements so as to define an air flow slot therebetween.

24 Claims, 3 Drawing Sheets

FIG. 3
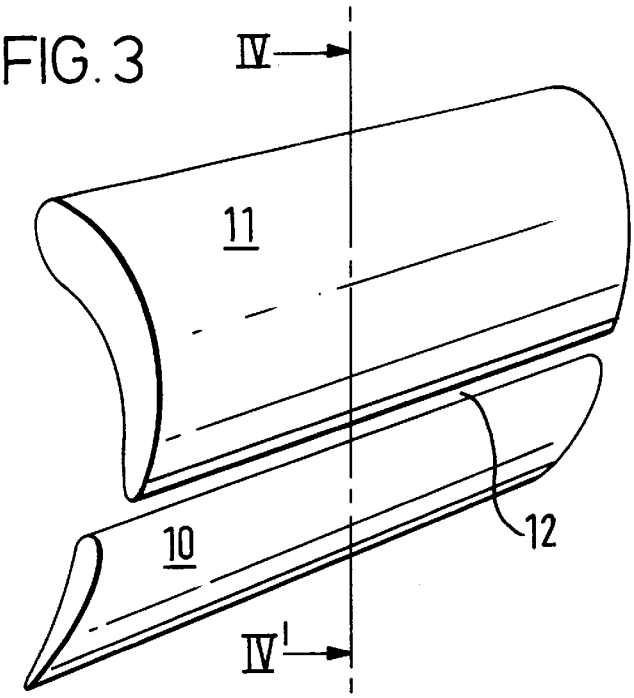
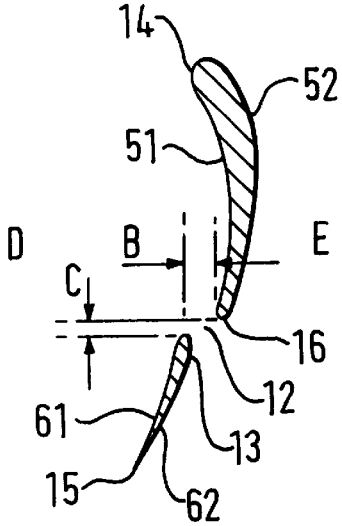
FIG. 4
FIG. 5
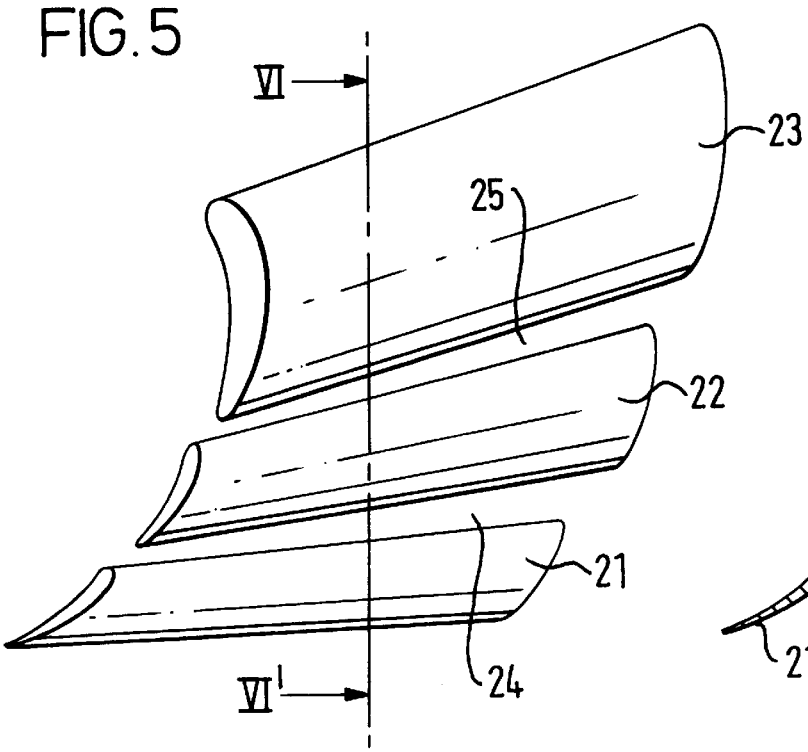
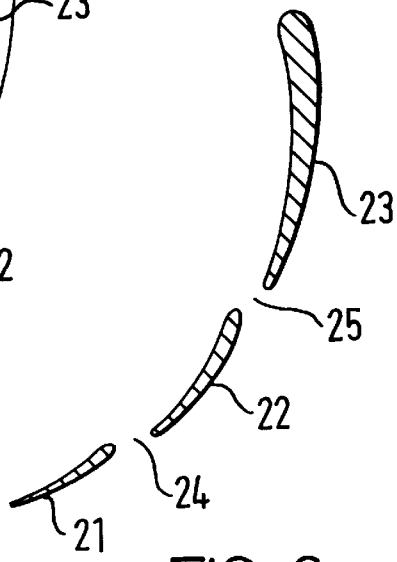
FIG. 6

FAN STATOR

SUMMARY OF THE INVENTION

The present invention relates to axial flow fans and in particular to a stator device for altering the air flow from the fan.

BACKGROUND OF THE INVENTION

Axial flow fans are commonly used in cooling systems for engines of vehicles. Such fans consist of a hub with a number of blades extending substantially radially from said hub to a tip region. The shape of the blades is such that as the fan itself is rotated, air is caused to move axially according to the direction of the rotation of the fan. It would be understood by those skilled in the art that axial flow fans impart rotational components to the air which they move, and this creates turbulence effects which can both reduce efficiency and increase the noise from the u se of the fan.

It is known to use so-called "stator devices" in association with such axial flow fans, which stator devices are intended to straighten the air flow resulting from the fan. Such stator devices are static arrangements of blades or other members which "break up" the rotational components of air movement and which deflect the air towards a more axial flow path.

Axial flow fans in engine cooling systems are disposed within a so-called shroud which guides the air from or to a vehicle heat exchanger such as a radiator and which may also guide the air to or from a condenser of a vehicle air conditioning system.

Motion of the vehicle causes air to be passed through the radiator and/or air conditioning condenser but under certain circumstances is necessary to provide further air movement and this is effected by the movement of the fan. It is desirable to use a high efficiency fan due to the need to reduce fuel consumption as far as possible and also due to the fact that inefficiencies of the fan tend to give rise to higher ambient noise which is undesirable in modern vehicles.

Modern engine fans are driven by electric motors, and the motors themselves are supported within an opening of the shroud by a number, commonly three, of arms which depend from the peripheral wall of the shroud to a support ring which serves to support the motor. Such supports are supplemented in known stator arrangements by a number of additional radially-extending members which are curved in cross-section, or otherwise shaped in the axial direction so as to generally straighten the motion of the air from the fan. A number of problems has been found to exist in the prior art. Specifically, due to the axially packaging constraints, the axial chord of the stator members is too small to provide efficient straightening of the air flow. Furthermore early flow separation may occur on the stators which substantially increases the drag and thus reduces the aerodynamic efficiency of the stator assembly itself.

It would be possible to overcome these limitations by increasing the camber of the stator profile, but this would limit the working range of the fan system to an undesirable extent.

OBJECTS OF THE INVENTION

It is a primary object of the present invention to at least partially mitigate the disadvantages of the prior art.

It is a further object of the present invention to increase the overall efficiency of a fan system by virtue of an enhanced stator stage, thus allowing for use of a smaller motor to provide the same amount of cooling effort from the fan system.

It is a further object of the present invention to reduce the weight of the fan assembly.

SUMMARY OF THE INVENTION

According to the present invention there is provided a stator device for an axial flow fan comprising plural stator members depending from a peripheral wall defining an opening for air flow from the fan, said members extending radially inwardly to a fan motor support member, wherein the stator device has an axially rearward extremity and an axially forward extremity, the rearward extremity, in use, being disposed more remote from the fan, and the forward extremity being disposed closer to the fan, plural stator members comprise a plurality of first stator elements and a corresponding plurality of second stator elements, the first stator elements being disposed axially rearwardly of the second stator elements whereby a forward edge region of the first stator element and a rearward edge of the second stator elements defines a slot therebetween.

Preferably the first and second stator elements are curved in cross section.

Advantageously the first and second stator elements have a greater thickness in their respective forward regions to their rearward regions.

According to a second aspect of the present invention there is provided an axial flow fan device comprising an axial flow fan disposed in a fan shroud in spaced relationship to a vehicle heat exchanger, the vehicle shroud having an internal peripheral wall defining an opening for air flow from the fan and the fan motor being secured to a fan support portion, the system further comprising a stator device depending from said wall and extending to said support portion, the stator device comprising a plurality of first stator elements and a corresponding plurality of second stator elements, the first stator elements being disposed axially rearwardly of the second stator elements whereby a forward edge region of the first stator element and a rearward edge of the second stator elements defines a slot therebetween.

Preferably the first and second stator elements are curved in cross section.

Advantageously the first and second stator elements have a greater thickness in their respective forward regions to their rearward regions.

According to a third aspect of the present invention there is provided a stator device for an axial flow fan, having an axially rearward and an axially forward extremity, the rearward extremity, in use, being disposed more remote from the fan and the forward extremity being disposed closer to the fan, the stator device comprising a plurality of first stator elements, a plurality of second stator elements, and a plurality of third stator elements, wherein the first stator elements are disposed axially rearwardly of the second stator elements and the third stator elements are disposed axially forwardly of the second stator elements whereby slots are provided between each of the first and second, and the second and third stator elements.

BRIEF DESCRIPTION OF THE DRAWINGS

For the purpose of illustrating the invention, embodiments will now be described with reference to the accompanying drawings in which:

FIG. 3 is a cut-away partial perspective view of a two element stator;

FIG. 4 is a cross-section through the device of FIGS. 3 along the lines (V–VI')

FIG. 5 is a cut-away partial perspective view of a three element stator in accordance with the invention; and FIG. 6 is a cross-section through the device of FIG. 5 along the lines VI–VI'.

DESCRIPTION OF THE PREFERRED EMBODIMENTS

Figure 1:
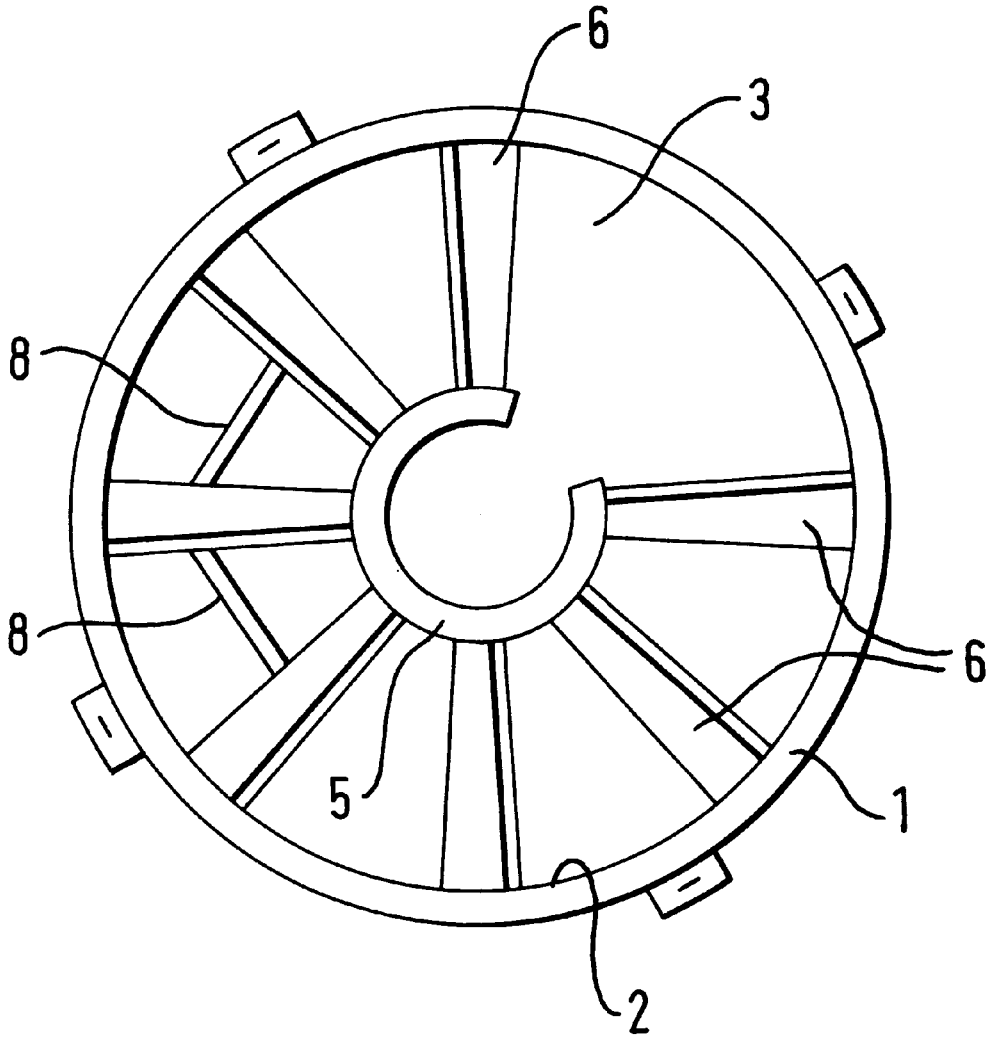
FIG. 1 is a partial plan view of an axial flow fan support acting as a stator.

In the figures like reference numerals refer to like parts.

Figure 2:
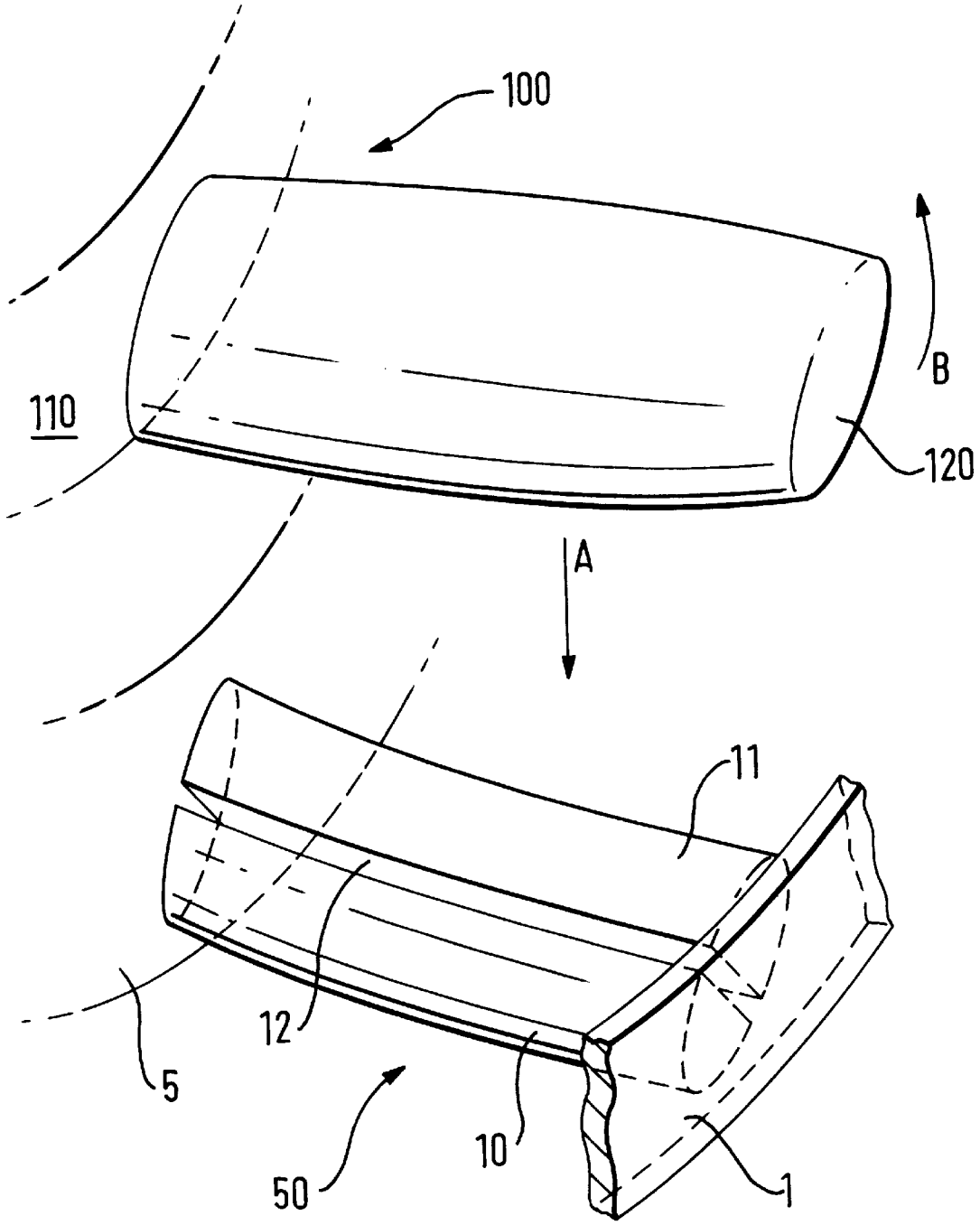
FIG. 2 shows a partial perspective view of fan assembly including a stator member of a stator in accordance with the invention.

Referring to FIG. 1 an outer ring 1 of a fan support device has an inner peripheral wall 2 which defines an opening 3 for air flow from an axial flow fan (see FIG. 2). As is known to those skilled in the art the support ring 1 may be part of a fan shroud or may be a separate structure secured to a shroud. Support rings of this type are well known in the art and are commonly made of moulded plastics material.

The support ring is generally circular. Within the ring is a fan motor support ring 5. The fan motor support ring is secured to the outer support ring 1 via plural (here 7) struts 6 which have the additional function of forming stator members for straightening out the air flow resulting from the fan. In the present device, the air flow is further straightened by air flow straightening members 8 intercalated between the stator members 6. Such straighteners are known in the art. Further struts could be provided which would have a purely supporting function: thus these struts would not have the air-flow straightening function of the struts 6.

The fan motor support ring 5 is shown as being of C-shape, but could be a complete circle. It serves to engage and support a fan motor (not shown) to the shaft of which is secured the hub of a fan—see FIG. 2.

Referring now to FIG. 2, a fan 100 consists of a generally circular hub portion 110 having an outer wall to which are secured plural blade members 120. Rotation of the hub in a counter-clockwise direction (shown by arrow B) causes air to be moved in the general direction shown by the arrow A. However, the movement of the fan blades entrains the air and causes it also to have a generally counter-clockwise motion.

A stator 50 consists of stator element 10 and 11.

Referring now to FIGS. 3 and 4, it will be seen that each of the stator elements 10,11 are generally curved in cross-section and that each of the stator elements 10,11 tapers from a respective forward edge region 13,14 to a respective axially-rearward edge region 15,16.

The first stator element 10 is disposed axially forwardly of the second stator element so that the forward edge region of the second stator element defines a slot 12 in co-operation with the axially rearward edge of the second stator element 11. The slot 12 has a substantial circumferential extent B, but, as shown, has little or no axial extent C.

The arrangement is however illustrative and other designs could be selected in accordance with the desired performance of the fan.

In operation, the combination of each pair of stator elements 10,11 provides a substantially airfoil shape and the slots, which are disposed closer to the trailing edge (in the last 50% of the chord length of the stator), provide a gap in the airfoil section so as to inject some air flow from the pressure side D of the stator 51,60 to the suction side E of the stator 52,62.

It has been found experimentally that the slot 12 should have a width of at most 20% of the cord length. The overall direction of the slot 12 should be at an angle with respect to the local slope of the profile section of between 0 and 90°.

The overall effect of the air flow injection from the pressure side D to the suction side E is to reduce the drag by preventing the flow from separating too early from the profiled surface. This therefore allows for a higher camber, and therefore better redirection of the air flow. The kinetic energy of the rotating fan acting upon the air which is moved by the fan is thus transformed more effectively into a static pressure.

Referring now to FIGS. 5 and 6, a second embodiment of the stator is shown, in which there are provided three stator elements 21–23 for each stator member. Each of the stator elements defines a respective slot 24,25 with the axially-preceding element to provide a similar effect to that shown in FIG. 3.

It would be understood by those skilled in the art that more than three stator elements could be provided, according to the effects desired.

Although embodiments of the invention have been described, these are not intended to be limitative. It will be understood by those skilled in the art that various changes in form and detail may be effected therein without departing from the spirit and scope of the invention as defined by the appended claims.

What is claimed is:

1. A stator device for an axial flow fan comprising a plurality of stator members depending from a peripheral wall defining an opening for air flow from the fan, said stator members extending radially inwardly to a fan motor support member, wherein the stator device has an axially rearward extremity and an axially forward extremity, the rearward extremity, in use, being disposed more remote from the fan, and the forward extremity being disposed closer to the fan, the plurality of stator members comprising a plurality of first stator elements and a corresponding plurality of second stator elements, the first stator elements being disposed axially rearwardly of the second stator elements wherein a forward edge region of the first stator elements and a rearward edge of the second stator elements defines a slot therebetween, the slot having a circumferential extent wider than an axial extent the axial extent, disposed substantially parallel to the direction of the air flow.

2. The stator device of claim 1 wherein the first and second stator elements are curved in cross section.

3. The stator device of claim 1 wherein the first and second stator elements have a greater thickness in their respective forward regions than their rearward regions.

4. The stator device according to claim 1 wherein the slot is configured to have a width of at most 20% of a length of the stator element.

5. The stator device according to claim 1 wherein the overall direction of the slot has an angle with respect to the local slope of the profile section in the range of 0° to 90°.

6. The stator device of claim 1, wherein the forward edge and the rearward edge do not overlap.

7. A motor vehicle having a heat exchanger comprising the stator device of claim 1.

8. An axial flow fan device comprising an axial flow fan disposed in a fan shroud in spaced relationship to a vehicle heat exchanger, the fan shroud having an internal peripheral wall defining an opening for air flow from the fan and a fan motor being secured to a fan support portion, the system further comprising a stator device depending from said wall and extending to said support portion, the stator device comprising a plurality of first stator elements and a corresponding plurality of second stator elements, the first stator elements being disposed axially rearwardly of the second stator elements wherein a forward edge of the first stator element and a rearward edge of the second stator elements defines a slot therebetween, the slot having a circumferential extent wider than an axial extent, the axial extent disposed substantially parallel to the direction of the air flow.

9. The fan device of claim 8 wherein the first and second stator elements are curved in cross section.

10. The fan device of claim 8 wherein the first and second stator elements have a greater thickness in their respective forward regions than their rearward regions.

11. The stator device according to claim 8 wherein the slot is configured to have a width of at most 20% of a length of the stator element.

12. The stator device according to claim 8 wherein the overall direction of the slot has an angle with respect to the local slope of the profile section in the range of 0° to 90°.

13. The axial flow fan device of claim 8, wherein the forward edge and the rearward edge do not overlap.

14. A motor vehicle having a heat exchanger comprising the axial flow fan device of claim 8.

15. A stator device for an axial flow fan, having an axially rearward and an axially forward extremity, the rearward extremity, in use, being disposed more remote from the fan and the forward extremity being disposed closer to the fan, the stator device comprising a plurality of first stator elements, a plurality of second stator elements, and a plurality of third stator elements, wherein the first stator elements are disposed axially rearwardly of the second stator elements and the third stator elements are disposed axially forwardly of the second stator elements wherein a slot is provided between each of the first and second, and the second and third stator elements, each slot having a circumferential extent wider than an axial extent, the axial extent disposed substantially parallel to the direction of the air flow.

16. The stator device of claim 15 wherein each of said stator elements is curved in cross-section.

17. The fan device of claim 15 wherein each of said stator elements has a greater thickness in their respective forward regions then their rearward regions.

18. The stator device according to claim 15 wherein the slot is configured to have a width of at most 20% of a length of the stator element.

19. The stator device according to claim 15 wherein the overall direction of the slot has an angle with respect to the local slope of the profile section in the range of 0° to 90°.

20. The stator device of claim 15, wherein a forward edge of the first stator elements do not overlap a rearward edge of the second stator elements.

21. The stator device of claim 15, wherein a rearward edge of the third stator elements do not overlap a forward edge of the second stator elements.

22. A motor vehicle having a heat exchanger comprising the stator device of claim 13.

23. An axial flow fan, comprising:

a first stator element having a first edge and a second stator element having a second edge, the first stator element being disposed axially rearwardly of the second stator element where the fist edge and the second edge defining a slot, the slot having a circumferential extent substantially greater than an axial extent, the axial extent disposed substantially parallel to a direction of air flow through the fan.

24. A motor vehicle having a heat exchanger comprising the axial flow fan of claim 23.

* * * * *